US011732541B2

(12) United States Patent
Stoesser et al.

(10) Patent No.: US 11,732,541 B2
(45) Date of Patent: Aug. 22, 2023

(54) DUAL TUBING STRING ADAPTOR

(71) Applicant: EVOLUTION OIL TOOLS INC., Calgary (CA)

(72) Inventors: Emery Stoesser, Calgary (CA); Vern Hult, Calgary (CA); Chris Patton, Calgary (CA)

(73) Assignee: EVOLUTION OIL TOOLS INC., Calgary (CA)

( * ) Notice: Subject to any disclaimer, the term of this patent is extended or adjusted under 35 U.S.C. 154(b) by 0 days.

(21) Appl. No.: 17/650,123

(22) Filed: Feb. 7, 2022

(65) Prior Publication Data

US 2022/0251919 A1 Aug. 11, 2022

Related U.S. Application Data

(60) Provisional application No. 63/146,404, filed on Feb. 5, 2021.

(51) Int. Cl.
*E21B 33/047* (2006.01)
*E21B 33/068* (2006.01)

(52) U.S. Cl.
CPC ..... *E21B 33/047* (2013.01); *E21B 33/068* (2013.01)

(58) Field of Classification Search
CPC ..... E21B 33/047; E21B 33/068
See application file for complete search history.

(56) References Cited

U.S. PATENT DOCUMENTS 2,694,450 A * 11/1954 Osbun ..... E21B 33/0415 166/75.14
5,794,693 A * 8/1998 Wright ..... E21B 33/047 166/85.5
2004/0154790 A1* 8/2004 Cornelssen ..... E21B 33/03 166/75.13
2004/0154800 A1* 8/2004 Jack ..... E21B 33/068 166/305.1
2004/0206507 A1* 10/2004 Bunney ..... E21B 33/068 166/312
2014/0020888 A1* 1/2014 Hanlin ..... E21B 33/047 166/84.1

* cited by examiner

*Primary Examiner* — D. Andrews
(74) *Attorney, Agent, or Firm* — Benesch, Friedlander, Coplan & Aronoff LLP

(57) ABSTRACT

An apparatus for hanging a production string and a coil tubing within a well, the apparatus comprising: a main body with a lower end defining an annular mounting flange; a production string tubing hanger bowl in the interior open area configured for accommodating the production tubing string suspended therein, the production string tubing hanger bowl having a center axis non-concentrically positioned relative to the annular mounting flange; and a coil tubing access port extending from the outer surface of the main body to an inner opening, the coil tubing access port configured for accommodating the coil tubing passing therethrough and having an angular orientation downwardly and being on an angle off vertical and directed away from a center point of the annular mounting flange.

5 Claims, 7 Drawing Sheets

DUAL TUBING STRING ADAPTOR

FIELD OF THE INVENTION

This invention relates to an apparatus for hanging a production tubing string and an auxiliary tubing string within a well casing.

BACKGROUND OF THE INVENTION

Many production oil wells are "dual string" wells, meaning that they include a production tubing string and an auxiliary tubing string located within the well casing.

The production tubing string serves to support the pump and sucker rods and provides a means to extract oil. The production tubing string is often rotated through a variety of different means or methods, such as a tubing rotator, in order to more evenly distribute wear on its inside surface due to contact with the sucker rods. Often, the production tubing is landed in the heel of the well.

The auxiliary tubing string in some instances is coil tubing. The coil tubing may act as another production string, where for example, two production tubing strings are for production from different zones in the well. Alternately, the coil tubing string operates to support a fluid supply or power or control lines. In one embodiment, for example, the coil tubing string is a flushing tube. In some operations, the flushing tube runs inside the casing, all the way to the toe of the well. In wells that include a liner, the flushing tube runs through the liner as well. Produced water may be recirculated through the flushing tube down to the toe to maintain fluid flow at enough velocity to keep the horizontal section clean. The flushing tube remains in the well during long periods of its producing life. The coil size is generally as large in diameter as possible for maximum circulation and flushing effectiveness For example 1¾" coiled tubing can be fitted into a 7" casing along with a 3½ inch production tubing.

Although such dual string wells have proven to be effective in many cases, the use of currently known apparatus and methods of configuring a dual string well with coil tubing often result in operational difficulties and high costs. For example, coil tubing is difficult to handle and bend around sharp radiuses and therefore is difficult to install. Also, existing dual string hangers are typically installed in the tubing head and service operations on the production tubing necessitates removing the coiled tubing as well. This adds a coiled tubing service rig to the operation so service operations take longer and are more expensive relative to a well equipped with a single production tubing string. Accordingly, when it becomes necessary to remove either the auxiliary string, or the production tubing string, a number of structures must be removed simultaneously from the well casing. If one string is pulled out or run in while the other remains in place, the two strings tend to get caught up with each other. The coil tubing, for example, can get caught on the coupling (i.e. larger diameter) connections of the production tubing. Thus, well maintenance in dual string installations can be time and labour intensive and very costly. Furthermore, existing dual string hanging devices often have no means for providing well control using the service rig BOP during installation or removal. Instead, kill fluids are added to the well to control the well pressure. However, gas may circulate up through the kill fluid at a velocity capable of lifting the kill fluid inside of the well casing and can result in an oil spill or possible blow out.

SUMMARY OF THE INVENTION

The invention therefore provides a dual string adaptor for a wellhead apparatus.

In accordance with one broad aspect of the invention, there is provided an apparatus for hanging a production tubing string and a coil tubing within a well casing having a wellhead, the apparatus comprising: a main body with an outer surface and an interior open area extending from an upper end to a lower end, the lower end defining an annular mounting flange; a production string tubing hanger bowl in the interior open area configured for accommodating the production tubing string suspended therein, the production string tubing hanger bowl being spaced above the annular mounting flange, with a center axis non-concentrically positioned relative to the annular mounting flange and defining therebelow a tubing string accommodating area that is positioned non-concentric relative to the annular mounting flange; and a coil tubing access port extending from the outer surface to an inner opening, the coil tubing access port configured for accommodating the coil tubing passing therethrough with and having an angular orientation downwardly and on an angle off vertical, from the exterior surface toward the inner opening and directed away from a center point of the annular mounting flange and away from the tubing string accommodating area.

In accordance with another broad aspect, there is provided a wellhead installation comprising: a well casing; an adaptor for hanging a production tubing string and a coil tubing within the well casing, the adaptor including: a main body with an outer surface and an interior open area extending from an upper end to a lower end, the lower end defining an annular mounting flange through which the adaptor is mounted above and in communication with the well casing; a production string tubing hanger bowl in the interior open area, the production string tubing hanger bowl being offset non-concentrically and above relative to the annular mounting flange; and a coil tubing access port extending from the outer surface to an inner opening, the coil tubing access port having an angular orientation sloping downwardly from the exterior surface toward the inner opening and angled away from a center point of the annular mounting flange; a tubing string suspended in the production string tubing hanger bowl hanging down in a position non-concentric relative to the annular mounting flange and defining a crescent-shaped open area between the tubing string and the annular mounting flange; and coil tubing suspended from the coil tubing access port in the crescent-shaped open area and directed by the angular orientation away from the tubing string.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF VARIOUS EMBODIMENTS

Figure 1:
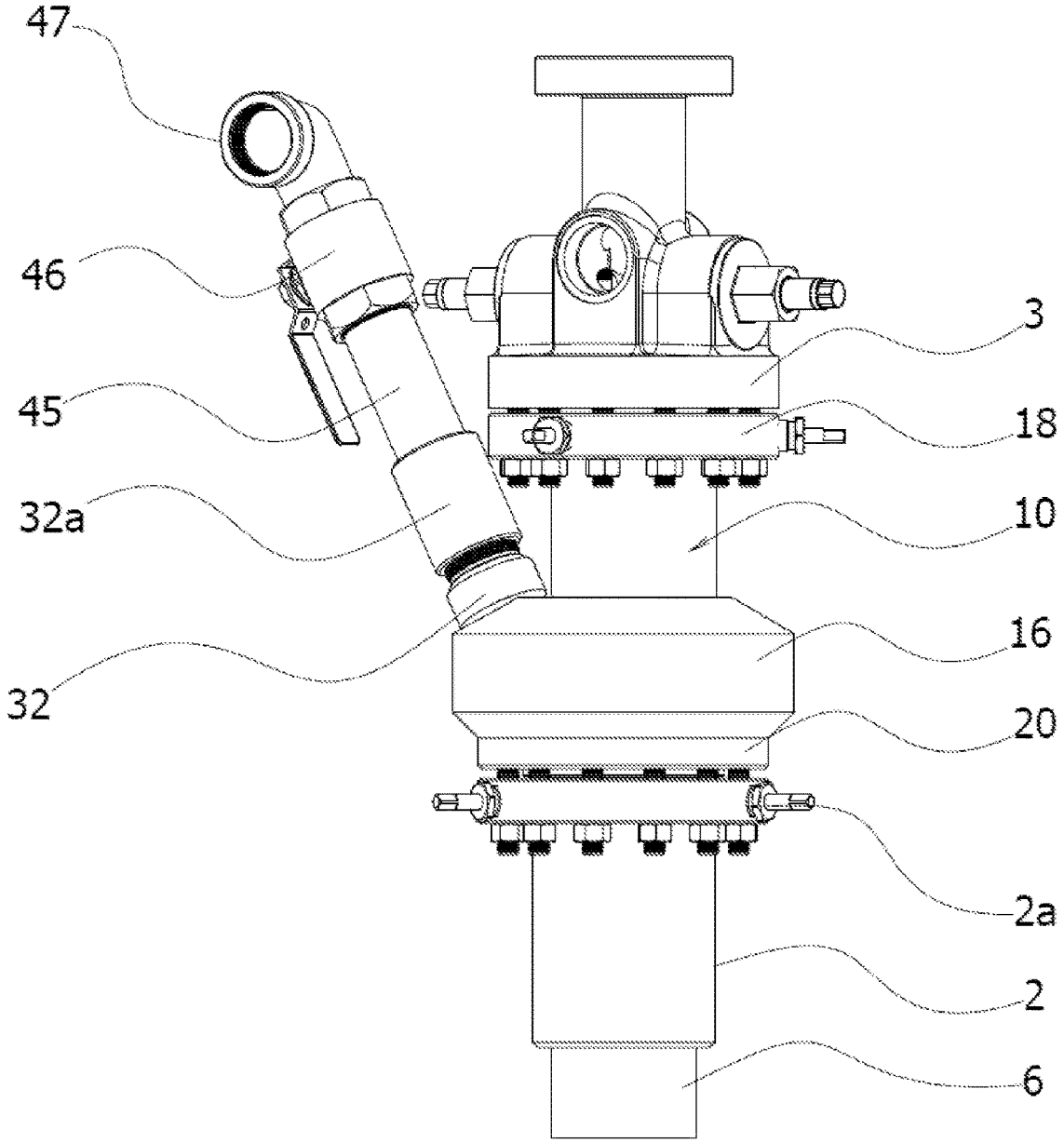
FIG. 1 is a side elevation of a wellhead installation including a dual string adaptor installed on a tubing head.
Figure 2:
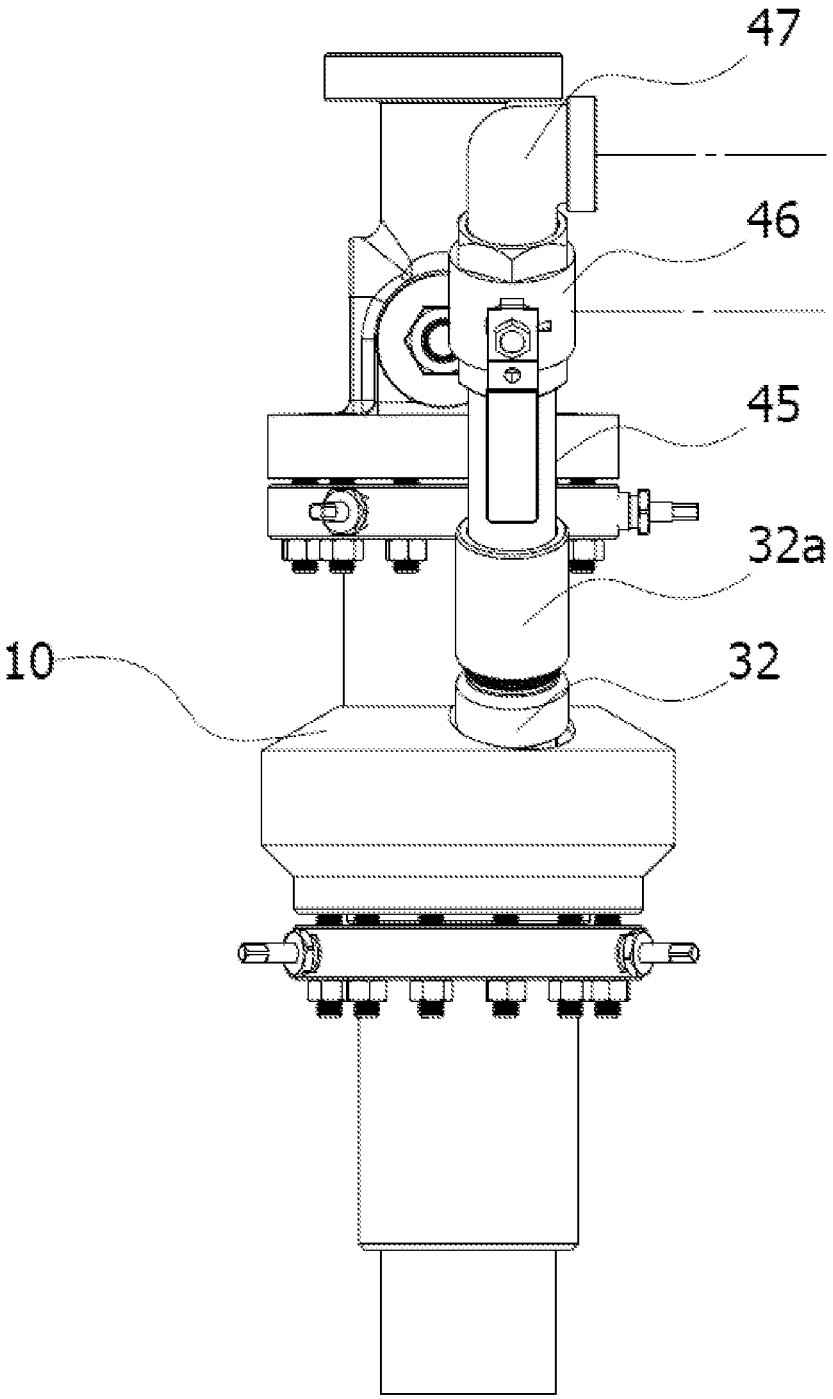
FIG. 2 is a side elevation of a wellhead installation of FIG. 1.

The present dual string adaptor offers several key attributes, including at least:

1. There is adequate room to allow the coil tubing to bend around to enter the well, 2. The strings are oriented with sufficient spacing therebetween to avoid interference between them, 3. The production string runs through the adaptor and is supported in a tubing hanger profile build into the adaptor above the entry point of the coiled tubing. The production string can be pulled without disturbing the coiled tubing string. The coiled tubing is run in through the lower flange of the adaptor and is supported by a tubing hanger connected to the lower flange of the adaptor. It can stay in place while the production string is removed and serviced. Alternatively, the coiled tubing string can be removed without removing the production string. This is achieved by having a production tubing hanging profile independent from and above the coiled tubing entry point to the casing annulus.

4. No special purpose tubing rotator is required, as the dual string adaptor can be configured to accommodate various rotators, 5. No special wellhead is required, and 6. The dual string adaptor facilitates access to the strings, but can limit fluid communication between the auxiliary string and the production tubing when one string is being accessed.

Various embodiments of a dual string adaptor 10, 10*a* are described with reference to FIGS. 1 to 7.

Referring to FIGS. 1 to 5, adaptor 10 is illustrated in a condition installed on a wellhead. Adaptor 10 includes a cylindrical body having an exterior surface 16, an upper end 18, a lower end 20, and an interior open area 22 extending between upper end 18 and lower end 20. Upper end 18 defines a first attachment flange or surface. Lower end 20 defines a second attachment flange or surface for the adaptor. As will be appreciated, attachment flanges are generally annular planar surfaces with holes for receiving bolts to attach to similarly shaped annular planar faces on other parts.

When in use, upper end 18 may support and be connected to further wellhead equipment such as a blow out preventor (BOP) 3 (FIG. 1) or tubing rotator 3*a* (FIG. 5) and lower end 20 is rigidly attached, directly or indirectly, to well casing 6. In the illustrated embodiment, lower end 20 is actually bolted to a flange 2*a* of a tubing hanger 2 coupled on the upper end of well casing 6.

Figure 3:
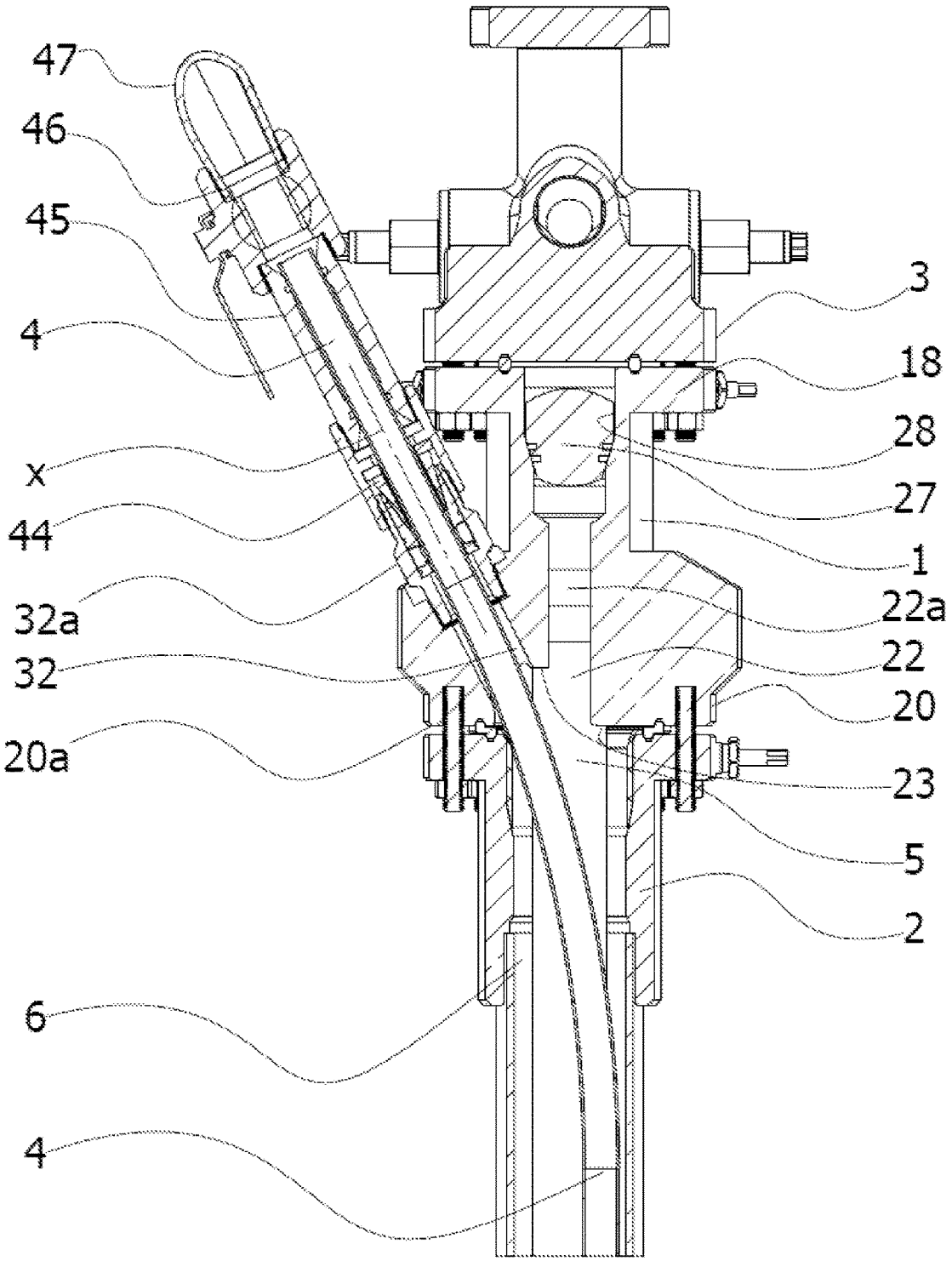
FIG. 3 is a section through the wellhead installation of FIG. 1, the section taken along the long axis of the coil tubing port.
Figure 5:
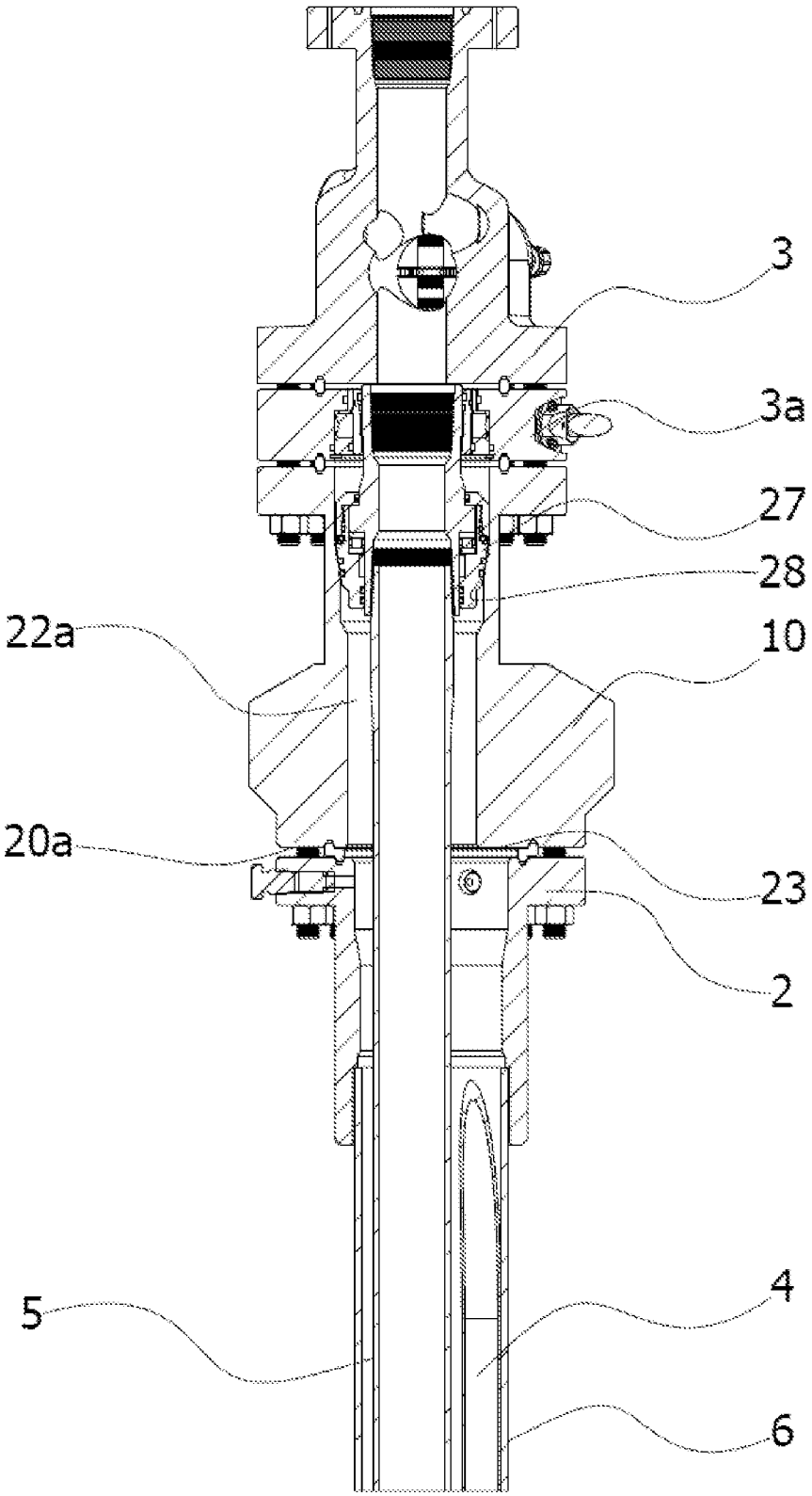
FIG. 5 is a section along line I-I of FIG. 4.

Lower end 20 has its annular flange 20*a* encircling an opening that permits access to interior open area 22. Annular flange 20*a* is a planar circular surface. The diameter across the annular flange at lower end is about the same as the inner diameter of the well casing 6 above which the adaptor 10 is to be attached. Interior open area 22 can take various forms. In the embodiment of FIG. 3, for example, interior open area 22 includes a concave area radially inwardly of the annular flange. FIG. 5 has an interior open area that is a lower face that is generally flat. This area is sometimes where the flange size is reduced.

Adaptor 10 is configured to support two strings. One string is a tubing string 5 and the other is a coil tubing string 4. Both strings are secured to the adaptor and are suspended to extend down from adaptor 10 and into casing 6.

Figure 4:
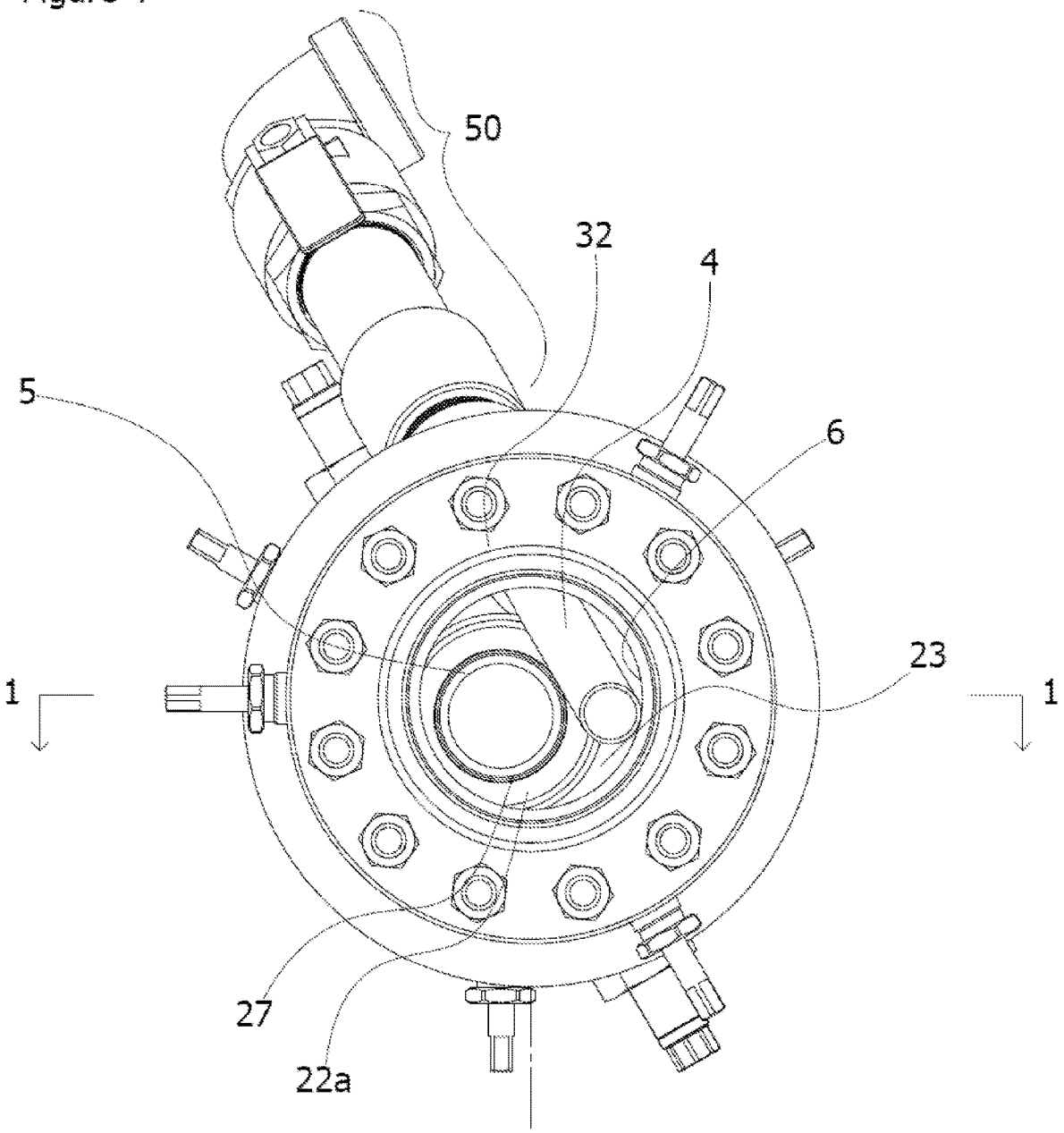
FIG. 4 is a section through another wellhead installation, where the section is taken orthogonally through the casing below the tubing head.
Figure 6:
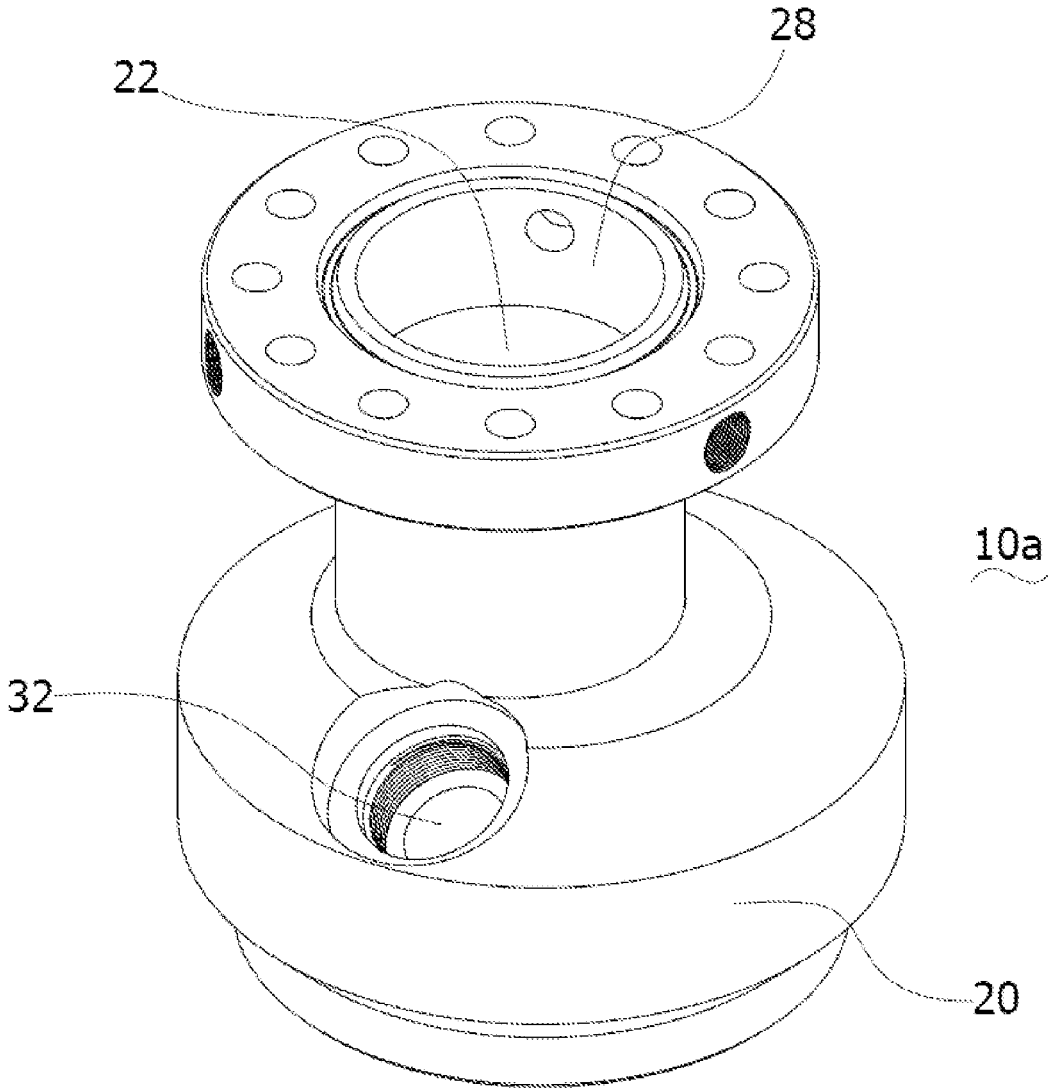
FIG. 6 is an isometric view of another dual string adaptor.

There is an internal bowl 28, usually called a tubing hanger profile, spaced above the lower end 20, and for example, generally close to upper end 18 of the adaptor body. Internal bowl 28 is open to interior open area 22. A portion of interior open area 22 defines a bore 22*a* extending vertically down from bowl 28 toward lower end. Tubing string 5 is suspended by means of a tubing hanger 27 on its upper end from internal bowl 28 and tubing string 5 extends down through the bore toward and down past lower end 20. Internal bowl 28 is configured to support the tubing string 5. Internal bowl 28 may be positioned closer to one side of the circle defining the lower end mounting flange 20*a*. As such, internal bowl 28 is non-concentric relative to the circular shape of annular flange 20*a* at lower end 20. This suspends tubing string 5 offset closer to a side of the planar expanse of lower end 20 rather than hanging centrally therethrough (FIG. 4). Thus, an area on the side of the adaptor interior area accommodates tubing string 5 hanging therein. That area extends directly below internal bowl 28 through and, vertically aligned below, bore 22*a*. As such, the area accommodating tubing string 5 is also non-concentric relative to the lower end mounting flange. This creates an open crescent-shaped area 23 (FIG. 4) relative to the circular mounting flange 20*a* on lower end 20 alongside the area where tubing string is accommodated. Internal bowl 28 may be integral with the rest of the adaptor (FIGS. 1 to 5) or a coupled structure connected to the rest of the adaptor (FIG. 6).

The crescent-shaped area 23 is the portion on the lower end between the opening to the bore 22*a* below bowl 28 and annular flange 20*a*. The crescent-shaped area may be the entire bottom of the adaptor in plan view except that area where bore 22*a* opens, which is below bowl 28.

Adaptor 10 also includes a coil tubing entry port 32 that is mounted closer to lower end 20 than tubing hanger bowl 28. Stated another way, the entry port 32 extends through the adaptor body and opens in the inner open area 22 somewhere in the vertical space between internal bowl 28 and lower end 20 of the adaptor body. Coil tubing access port 32 extends from an opening on exterior surface 16 to an inner opening in the crescent-shaped area 23 within the adaptor. The inner opening of the coiled tubing port is located closer to lower end 20 than the tubing hanger bowl 28, so the coiled tubing can freely enter area 23. In one embodiment, coil tubing port 32 is integral with the lower flange of the adaptor so the coil can enter the interior open area below the production tubing hanger 28.

The coil tubing access port opens into the crescent-shaped area 23. The port 32 is a cylindrical bore that extends along a long axis x. FIG. 3 is sectioned along the long axis x of the coil tubing access port 32. The port's long axis x extends, sloping at an angular orientation, downwardly and on an angle off vertical, from the exterior surface 16 toward lower end 20 of adaptor 10. In addition, the port 32, as indicated by its axis, is directed away from the center point based on the circular shape of flange 20*a* on lower end 20. In particular, when viewed from below, the long axis extends along a non-diametric secant relative to the circular shape of flange 20*a* on lower end 20. In particular, axis x is directed away from the vertical area along which tubing string 5 is accommodated. That is the area within the adaptor below internal bowl 28. In the embodiment of FIG. 3 for example, coil tubing access port 32 is angled such that it's long axis x is not directed toward the side of the interior open area 22 that accommodates the tubing string 5. In the embodiment of FIG. 5 for example, port 32 is not angled toward and does not open into bore 22*a*. For a better understanding and stated another way, if a plane were defined as parallel to and extending through both the vertical axis of bowl and the vertical center axis through flange 20*a* (i.e. a plane extending vertically and into the depth of FIG. 3), the extension of axis x of the coil tubing access port would cut across that plane. The entire length of the port 32 may be on one side of the plane, but the coil passing through the port cuts across the plane on an angle. This selected angular orientation of the coil tubing access port relative to flange 20*a*, means that the coil tubing 4, as it passes through access port 32 is directed into crescent-shaped area 23 and across the underside of adaptor toward or against a sidewall 22*b* of the interior open area or a side wall of the well casing below. This angular orientation of port 32 permits the coil tubing to gradually bend around from its entry point to interior open area 22 to extend down inside the well casing. The coil tubing is not directed directly toward tubing string 5 but instead along a wall of the interior open area or a wall of the well casing below. As such, the coil tubing hangs alongside the tubing string 5 but at least initially out of contact with the tubing string outer wall (FIG. 4). This avoids contact during running in the coiled tubing between the end of the coiled tubing and the couplings on the production tubing.

Regarding the tubing hanger bowl 28 being shifted as far off center as possible, the limitation is the couplings on the tubing 5 contacting the ID of the casing 6. With the production tubing shifted as far off center as possible, the crescent shape between the casing ID and the production tubing 5 OD is as large as possible and the coil is introduced into that crescent-shaped area 23.

The port can be formed as a bore through the body of the adaptor as shown in FIG. 6. Alternately, as shown in FIGS. 1 to 5, the coil tubing access port 32 can include a tubular extension 32*a* protruding from the outer surface 16. The upward extension from the coiled tubing port 32 can contain a sealing mechanism configured for being biased to the outside of the coiled tubing and/or to contain slips or other means to hang the coil.

Figure 7:
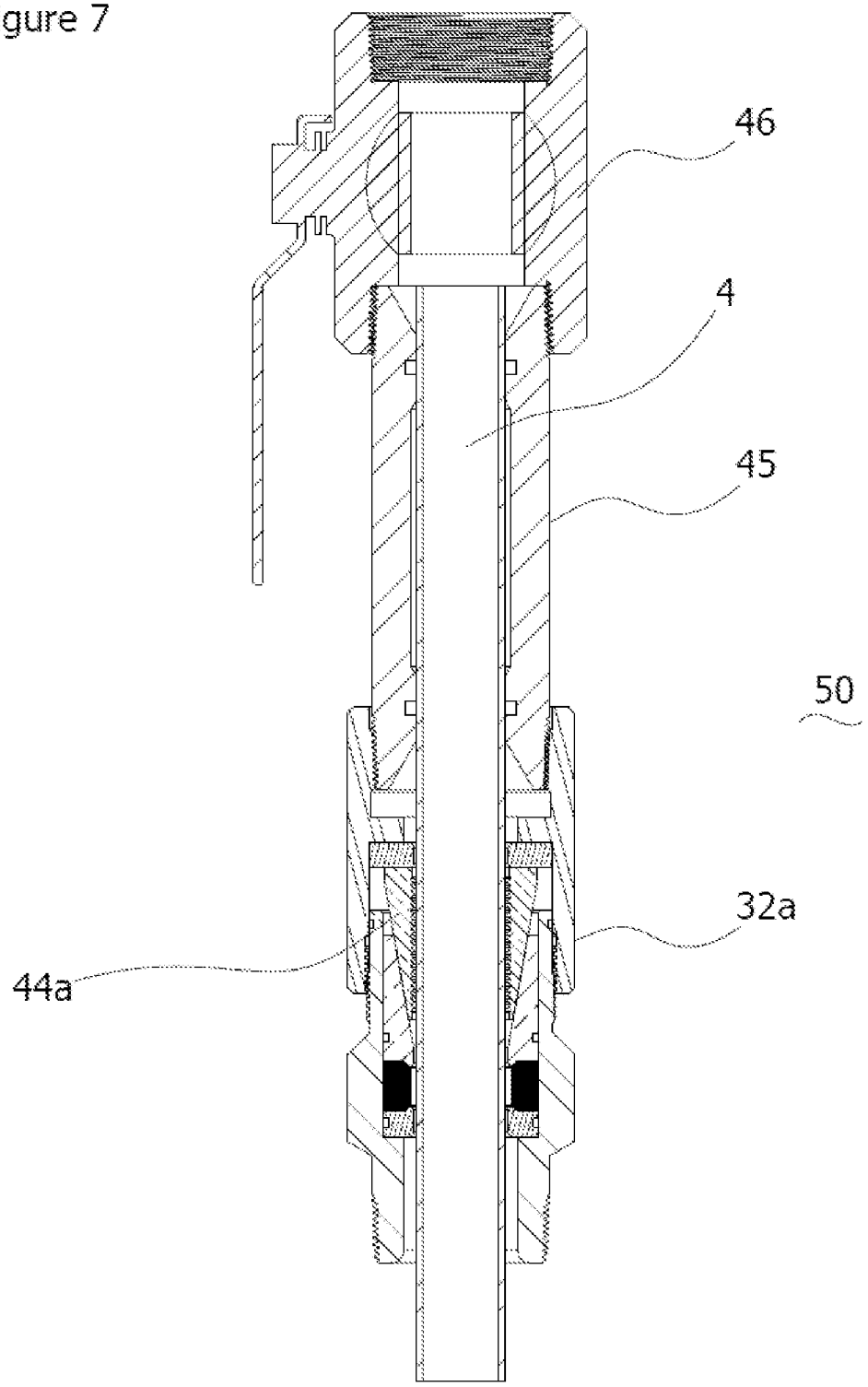
FIG. 7 is an enlarged view of a coil tubing hanger useful in the present invention.

Coil tubing access port 32 may have an insert 44 that acts as a hanger, wear guide or both. A wear guide may be a sleeve that is manufactured from a material less abrasive to the coil tubing than the steel of the adaptor and tubular extension. Insert 44 that acts as a hanger includes slips 44*a* or other means that secure the coil tubing in position in port 32, suspended from the adaptor (FIG. 7). The coiled tubing hanger 44 is connected to the lower flange of the adaptor so the coil can enter the interior open area below the production tubing hanger 28.

In one embodiment, an extension 50 may be secured on coil tubing access port 32. The extension may include tubular extension 32*a* to thread into port 32, slips 44*a*, a seal section 45, a flow controller such as a ball valve 46 and a connector 47.

In operation, the operator can install the dual string head and run a flush line of coil tubing 4 alongside a production tubing string 5. The coil tubing may be run in through the access port 32 and the angular orientation of the access port, which is down on an angle non-diametrically along a secant relative to the inner diameter of the interior open area, into the crescent shaped area 22*a* alongside but not at the tubing string 5. This directs the coil tubing around a gradual radius and down into the well.

The coil tubing can be inserted down to the toe of the well. A continuous flushing flow can be conveyed through the tubing to maintain the well free of sand and debris during production.

The dual tubing string hanging apparatus 1 may be configured to operate with any or all of a BOP 3, an auxiliary string hanger, a rotating hanger and a tubing rotator 3*a* (FIG. 5), as desired.

It is to be understood that what has been described are preferred embodiments of the invention and that it may be possible to make variations to these embodiments while staying within the broad scope of the invention. Some of these variations have been discussed while others will be readily apparent to those skilled in the art.

We claim:

1. An apparatus for hanging a production tubing string and a coil tubing within a well casing having a wellhead, the apparatus comprising:

a main body with an outer surface and an interior open area extending from an upper end to a lower end, the lower end defining an annular mounting flange;

a production string tubing hanger bowl in the interior open area configured for accommodating the production tubing string suspended therein, the production string tubing hanger bowl being spaced above the annular mounting flange, with a center axis non-concentrically positioned relative to the annular mounting flange and defining therebelow a tubing string accommodating area that is positioned non-concentric relative to the annular mounting flange;

a crescent-shaped area in the interior open area that is between the tubing string accommodating area and the annular mounting flange; and a coil tubing access port extending from the outer surface to an inner opening that opens into the crescent-shaped area, the coil tubing access port configured for accommodating the coil tubing passing therethrough and the coil tubing access port having an angular orientation downwardly and on an angle off vertical, from the outer surface toward the inner opening and a long axis of the coil tubing access port at the inner opening is directed away from a center point of the annular mounting flange along a non-diametric secant relative to the annular mounting flange and away from the tubing string accommodating area.

2. The apparatus of claim 1, wherein the angular orientation directs a suspended coil tubing away from the tubing string accommodating area.

3. The apparatus of claim 1, further comprising a coil tubing hanger for the coil tubing access port.

4. A wellhead installation comprising:

a well casing;

an adaptor for hanging a production tubing string and a coil tubing within the well casing, the adaptor including:

a main body with an outer surface and an interior open area extending from an upper end to a lower end, the lower end defining an annular mounting flange through which the adaptor is mounted above and in communication with the well casing;

a production string tubing hanger bowl in the interior open area, the production string tubing hanger bowl being offset non-concentrically and above relative to the annular mounting flange; and a coil tubing access port extending from the outer surface to an inner opening, the coil tubing access port having an angular orientation sloping downwardly from the outer surface toward the inner opening and angled away from a center point of the annular mounting flange;

a tubing string suspended in the production string tubing hanger bowl hanging down in a position non-concentric relative to the annular mounting flange and defining a crescent-shaped open area between the tubing string and the annular mounting flange; and coil tubing suspended from the coil tubing access port in the crescent-shaped open area and directed by the angular orientation along a non-diametric secant relative to the annular mounting flange and away from the tubing string.

5. The wellhead installation of claim 4, further comprising a coil tubing hanger for the coil tubing access port.

* * * * *